US005343797A

United States Patent [19]

Ochiai et al.

[11] Patent Number: 5,343,797

[45] Date of Patent: Sep. 6, 1994

[54] CYLINDER DEVICE

[75] Inventors: Akira Ochiai, Susono; Akihiko Yuasa; Shigeki Otaka, both of Numazu, all of Japan

[73] Assignee: Toshiba Kikai Kabushiki Kaisha, Tokyo, Japan

[21] Appl. No.: 42,271

[22] Filed: Apr. 2, 1993

[30] Foreign Application Priority Data

Apr. 2, 1992 [JP] Japan ..... 4-080684

[51] Int. Cl.[5] ..... F01B 11/02

[52] U.S. Cl. ..... 92/85 A; 92/51; 92/53

[58] Field of Search ..... 92/85 R, 85 A, 51, 52, 92/53; 91/167 R, 170 R, 170 MP, 173, 181

[56] References Cited

U.S. PATENT DOCUMENTS 344,038 6/1886 Fitts ..... 92/85 A
1,095,926 5/1914 Powell ..... 92/85 R
3,164,066 1/1965 Frye et al. ..... 91/173
3,905,278 9/1975 Ourdouillie ..... 92/85 A
4,922,722 5/1990 Kazumoto et al. ..... 92/85 A

FOREIGN PATENT DOCUMENTS 2128982 1/1973 Fed. Rep. of Germany ..... 92/85 A

*Primary Examiner*—Thomas E. Denion
*Attorney, Agent, or Firm*—Fish & Richardson

[57] ABSTRACT

A cylinder device which is capable of restraining the total length thereof to a shorter length even when the stroke is made longer, and which thereby provides the compact appearance and layout of, for example, a machine tool, in which the cylinder device is used. The cylinder device includes a first cylinder provided with an extensible piston rod. The piston rod is constituted as a cylinder tube of a second cylinder. The extensible piston rod of the second cylinder is formed in the interior thereof with a flow path for guiding a working fluid into a cylinder chamber of the second cylinder constituted by the piston rod of the first cylinder.

2 Claims, 4 Drawing Sheets

CYLINDER DEVICE

FIELD OF THE INVENTION

This invention relates to a cylinder device most suitable, for example, for use in a double housing balancing device which supports a cross beam of a double housing type large machine tool or a ram balancing device thereof, and furthermore, for use in the conveying of pallets, works or the like, which requires a relatively longer stroke.

BACKGROUND OF THE INVENTION

A general cylinder device in the prior art is constituted so that a piston is slidably accommodated in a cylinder chamber within a cylinder tube, while a piston rod is connected to the piston, and a working fluid such as oil or air is introduced into one room of the cylinder chamber defined by said piston so that a pressure is applied to one surface of the piston, and similarly to this, the working fluid is introduced into the other room of the cylinder chamber, or an exterior mechanical force is actuated thereon, whereby the piston and accordingly the piston rod is moved in a reciprocating motion according to the relation of both forces.

However, in the above-mentioned prior art cylinder device, there is a problem that if an attempt is made to lengthen the stroke of the cylinder device, the cylinder tube also becomes longer in length in proportion to the lengthened stroke, thus making the production of a smaller-sized cylinder device difficult.

That is, if an attempt is made to obtain a sufficient stroke by using the above-described cylinder device for, for example, a double housing balancing device which supports the cross beam of a double housing type large machine tool, the cylinder devices protrude from the columns of the machine tool toward the ceiling at the right and left positions. Conversely, if the cylinder device is short in stroke, the total length thereof becomes large when it retracts, thus resulting in a large distance between the cross beam and the bed of the machine tool. In short, under the existing circumstances, even if the provision of a large machine tool is planned for a factory, the restriction in the height of the structure of the factory limits the intended range of machining a work, and furthermore, the cylinder devices protruding from the columns obstruct the travelling of a crane when the devices are in operation after being installed in the factory.

SUMMARY OF THE INVENTION

Accordingly, it is an object of the invention to provide a cylinder device which is capable of restraining the total length thereof to a shorter length even when the stroke is made longer, thereby providing a compact appearance and layout of, for example, a machine tool, for which the cylinder device is used.

According to the invention, there is provided a cylinder device, which comprises a first hollow cylinder tube having a supply flow path formed therein for a working fluid;

a second hollow cylinder tube fitted in said first cylinder tube for extension and retraction;

a means for supplying the working fluid into said second cylinder tube, a second piston rod fitted in said second cylinder tube for extension and retraction;

a first cushion mechanism mounted in an end of said second cylinder tube directed towards said first cylinder tube; and a second cushion mechanism mounted in an end of said second piston rod directed towards said second cylinder tube.

The cylinder device of the invention as constituted above enables the piston rod of the first cylinder to be extended the amount of the stroke thereof, and further enables the second cylinder, which is the piston rod made as a cylinder tube, to be further extended the amount of the stroke of the second cylinder. Accordingly, the stroke of the cylinder device becomes the sum total of the respective strokes of the first and second cylinders, thereby providing a longer stroke.

BRIEF DESCRIPTION OF THE DRAWINGS

Other objects and aspects of the invention will become apparent from the following description of an embodiment with reference to the accompanying drawings, in which.

DETAILED DESCRIPTION OF THE EMBODIMENT

Figure 1:
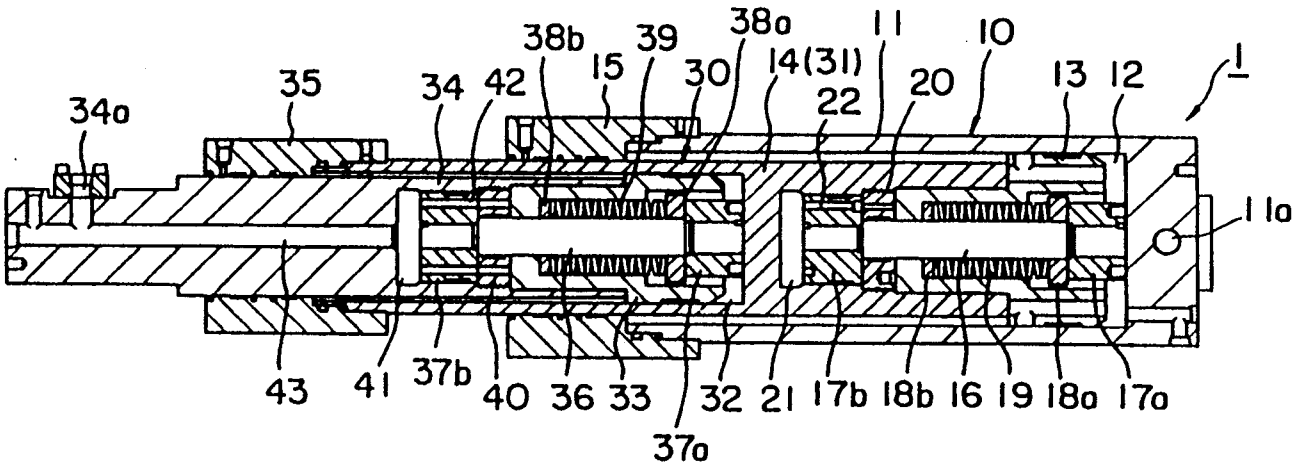
FIG. 1 is a sectional view of an embodiment of a cylinder device according to the invention showing a retracted condition thereof.
Figure 2:
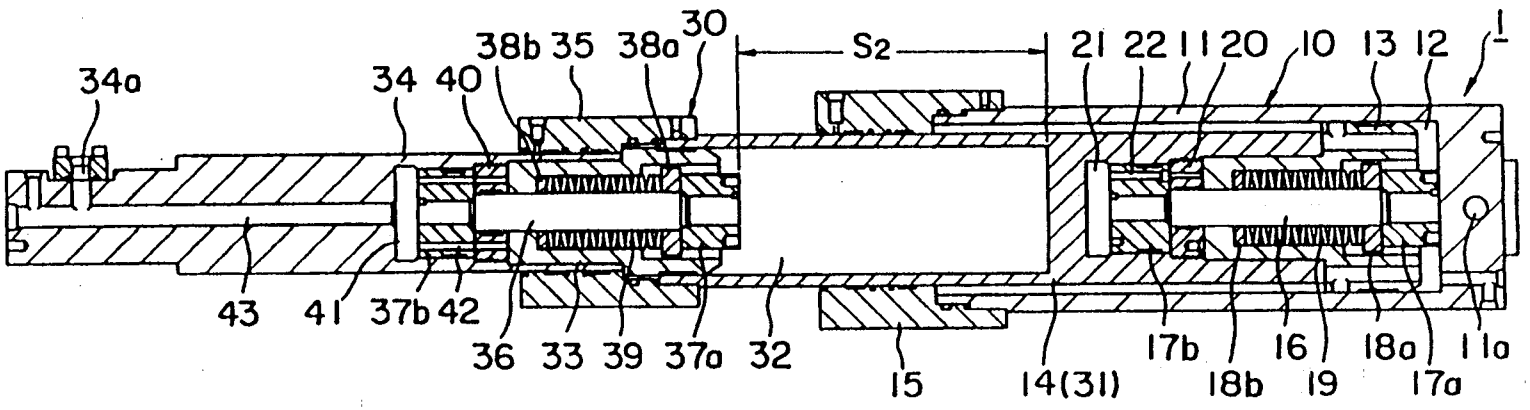
FIG. 2 is a sectional view of the cylinder device of FIG. 1 showing an extended condition of the second cylinder.
Figure 3:
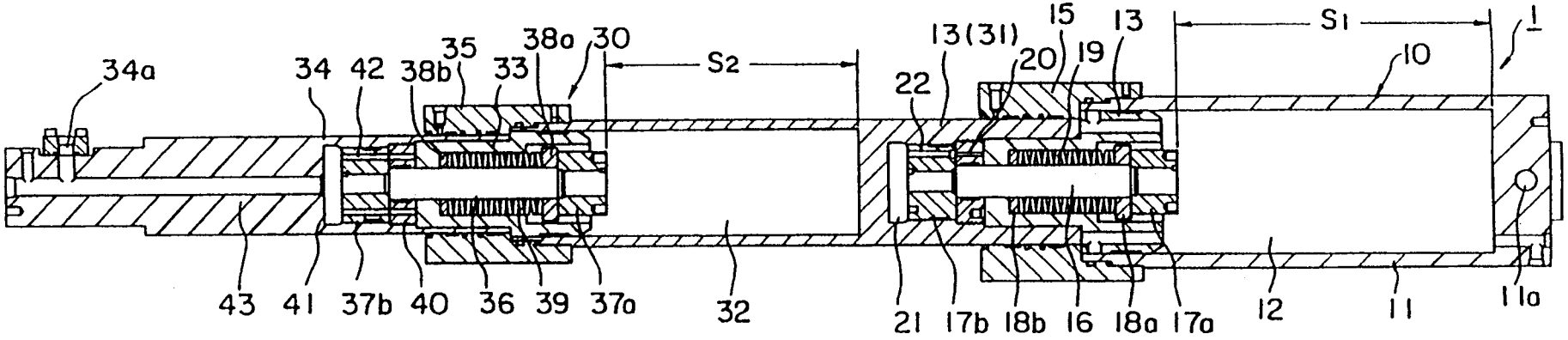
FIG. 3 is a sectional view of the cylinder device of FIG. 1 showing an extended condition of both the first and second cylinders.

FIGS. 1 to 3 show an embodiment of the invention. A cylinder device 1 in this embodiment mainly comprises a first cylinder 10 having a larger diameter and a second cylinder 30 having a smaller diameter accommodated in the first cylinder 10 for extension and retraction.

The first cylinder 10 comprises a cylinder tube 11 which is closed at the back end thereof. A piston 13 is slidably accommodated in a cylinder chamber 12 within the cylinder tube 11, and an oil port 11*a* for introducing oil as a working fluid into the cylinder chamber 12 is provided in the wall at the back end of the cylinder tube 11.

A piston rod 14 extending forward substantially in the form of a cylinder is connected to the piston 13, and a rod cover 15 which plays a roll as a sealing is mounted between the opening end of the cylinder tube 11 and the outer periphery of the piston rod 14.

With this construction, when oil under pressure is introduced from the oil port 11*a* into the cylinder chamber 12, the pressure of the working oil is applied to the end surface of the piston 13 directed towards the cylinder 11 to thereby move it forward, so that the piston rod 14 is extended. When the oil accumulated within the cylinder chamber 12 is discharged from the oil port 11*a* by a mechanical force, such as a dead weight or the like, which acts on the end surface of the piston 13 directed towards the rod from the exterior through the piston rod 14, the piston rod 14 is retracted.

The piston 13 is provided with a cushion mechanism for relieving a shock.

That is, a guide bar 16 is inserted through the interior of the piston 13, and it is connected to the piston rod 14 through a pair of piston nuts 17*a* and 17*b* threadably connected to both ends of the guide bar 16. Furthermore, belleville springs 19 are interposed between the piston 13 and one of the piston nuts 17*a* at the cylinder side through a pair of washers 18*a* and 18*b*, and a ring 20 is interposed between the piston 13 and the other piston nut 17*b* at the piston rod side.

Moreover, a cushion chamber 21 is formed between the inner peripheral surface of the piston rod 14 and the end surface of the piston nut 17*b* directed towards the piston rod, and the cushion chamber 21 and the cylinder chamber 12 communicate with each other through a communicating hole 22.

With this construction, any shock caused by some collision of the piston is relieved by the retraction of the belleville springs 19, and the shift of the guide bar 16 due to such a shock relieving operation is absorbed by the cushion chamber 21.

A cylinder tube 31 of the second cylinder 30 is constituted by the piston rod 14 of the first cylinder 10. That is, the piston rod 14 and, accordingly, the whole second cylinder 30 is moved (forward and backward) relative to the first cylinder 10 by the operation of the first cylinder 10.

With this construction, an amount S of the stroke of the cylinder device is the amount (S1+S2) obtained by adding the amount S1 of the stroke of the first cylinder 10 to the amount S2 of the stroke of the second cylinder 30.

Now, the second cylinder 30 will be explained. A piston 33 is slidably accommodated in a cylinder 32 of the cylinder tube 31 (that is, the piston rod 14 of the first cylinder 10) of the second cylinder 30.

A piston rod 34 extending forward in the form of a cylinder is connected to the piston 33, and a rod cover 35 which plays a role of sealing is mounted between the opening end of the cylinder tube 31 and the outer peripheral surface of the piston rod 34.

The piston 33 is provided with a cushion mechanism for relieving a shock.

That is, a guide bar 36 is inserted through the interior of the piston 33, and the piston 33 and the piston rod 34 are connected to each other through a pair of piston nuts 37*a* and 37*b* threadably connected to both ends of the guide bar 36. At the same time, belleville springs 39 are interposed between the piston 33 and one of the piston nuts 37*a* at the cylinder side through a pair of washers 38*a* and 38*b*, and a ring 40 is interposed between the piston rod 33 and the other piston nut 37*b* at the rod side.

Moreover, a cushion chamber 41 is formed between the inner peripheral surface of the piston rod 34 and the end surface of the piston nut 37*b* directed towards the rod, and the cushion 41 and the cylinder chamber 32 communicate with each other through a communicating hole 42. With such a construction, any shock caused by some collision of the piston is relieved by the contraction of the belleville springs 39, and the shift of the guide bar 36 due to the relieving of the shock is absorbed by the cushion chamber 41.

In addition, an oil port 34*a* for introducing oil as a working fluid is provided at the end of the piston rod 34, and the oil port 34*a* and the cushion chamber 41 communicate with each other through a flow path 43 formed in the piston rod 34.

With the construction as described above, when oil under pressure is introduced into the cylinder chamber 32 passing through the oil port 34*a*, flow path 43, cushion chamber 41 and communicating hole 42, the pressure of the working oil is applied to the end surface of the piston 33 directed towards the cylinder to thereby move it forward, so that the piston rod 34 is extended. When the oil reserved in the cylinder chamber 32 is discharged from the oil port 34*a* through the above-described flow path in reverse by a mechanical force, such as a dead weight or the like, which acts on the end surface of the piston rod 33 directed towards the rod, the piston rod 34 is retracted.

Figure 4:
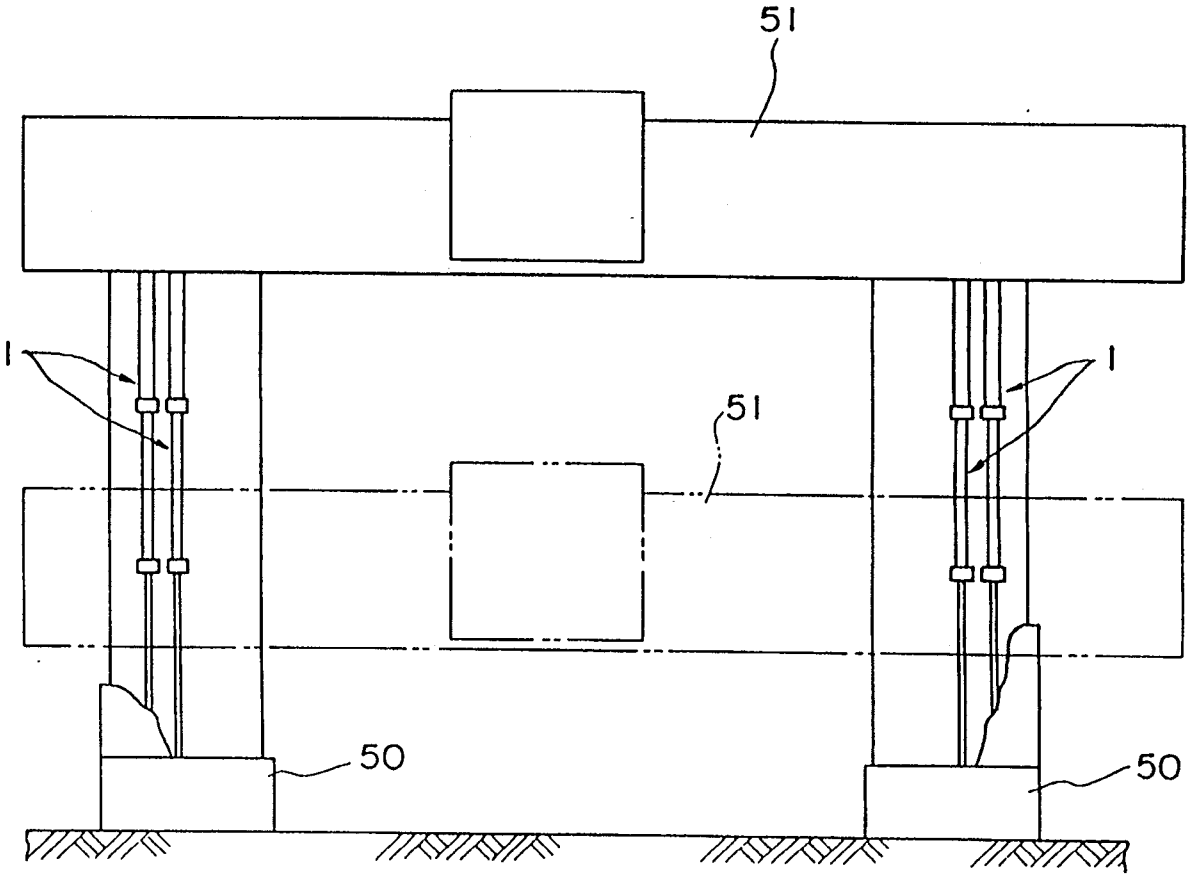
FIG. 4 is a front view showing an example of application of the cylinder device according to the invention.

FIG. 4 shows an example of an application of the cylinder device 1 as constituted above, that is, an example in the case where it is used as a cylinder device of a double housing balancing device of a double housing type large machine tool.

The double housing balancing device serves to hold a cross beam 51 for up and down motion which bridges the upper ends of a pair of columns 50 standing erect, and the above-described cylinder device 1 is used for carrying out the up and down motion of the cross beam 51.

In this way, use of the cylinder device 1 having a greater stroke for the short total length provides a sufficient stroke without the cylinder devices having to protrude from the columns 50 of the machine tool toward the ceiling at the right and left positions, and besides, the shorter total length of the cylinder device, when it is retracted, prevents the height from the bed to the cross beam from becoming great, thereby enabling the external appearance and layout of the machine tool to be more compact.

Moreover, the cylinder device can certainly be used, for example, as a cylinder device for a ram balancing device, swivel balancing device and transfer device in a machine tool, and further, as a cylinder device for pallet conveyance, work conveyance and tool conveyance which require longer strokes in a machine tool.

Furthermore, the present embodiment shows an example in which the two cylinder tubes are combined; however, such a combination may be a combination of more than two cylinder tubes, for example, three or four cylinder tubes. With the construction as described above, the present invention provides a longer stroke in spite of a short total length of the cylinder device, and offers such an advantageous effect as to be able to contribute to a more compact external appearance and layout when the cylinder device is used, for example, in a machine tool.

What is claimed is:

1. A cylinder device, comprising:

a hollow cylinder tube having a supply flow path formed therein for a working fluid;

a first piston slidably accommodated in said hollow cylinder tube;

a first guide bar inserted through said first piston;

a first piston rod connected to said first piston through said first guide bar and provided with a cylindrical room therein;

said first piston rod being provided with a first cushion chamber formed between an inner peripheral surface of said piston rod and an end portion of said guide bar;

a plurality of belleville springs provided between said guide bar and an inside of said first piston;

a second piston slidably accommodated in said cylindrical room of said first piston rod;

a second guide bar inserted through said second piston;

a second piston rod connected to said second piston through said second guide bar;

said second piston rod being provided with a second cushion chamber formed between an inner peripheral surface of said piston rod and an end portion of said guide bar;

a plurality of belleville springs provided between said guide bar and an inside of said second piston; and a means for supplying the working fluid into said cylindrical room of said first piston rod.

2. A double housing type machine tool, comprising:

a double housing balancing device and a cylinder device having a hollow cylinder tube having a supply flow path formed therein for a working fluid;

a first piston slidably accommodated in said hollow cylinder tube;

a first guide bar inserted through said first piston;

a first piston rod connected to said first piston through said first guide bar and provided with a cylindrical room therein;

said first piston rod being provided with a first cushion chamber formed between an inner peripheral surface of said piston rod and an end portion of said guide bar;

a plurality of belleville springs provided between said guide bar and an inside of said first piston;

a second piston slidably accommodated in said cylindrical room of said first piston rod;

a second guide bar inserted through said second piston;

a second piston rod connected to said second piston through said second guide bar;

said second piston rod being provided with a second cushion chamber formed between an inner peripheral surface of said piston rod and an end portion of said guide bar;

a plurality of belleville springs provided between said guide bar and an inside of said second piston; and a means for supplying said working fluid into said cylindrical room of said first piston rod;

said double housing balancing device for holding a cross beam for up and down motion by said cylinder device, said cross beam bridging a pair of columns standing parallel to each other.

* * * * *